United States Patent [19]

Benitez

[11] Patent Number: 4,769,869

[45] Date of Patent: Sep. 13, 1988

[54] MULTIPLE USE CLEANING UTENSIL

[76] Inventor: Ovidio Benitez, 19920 E. Oakmont, Miami Lakes, Fla. 33015

[21] Appl. No.: 75,481

[22] Filed: Jul. 20, 1987

[51] Int. Cl.[4] ..... A47L 13/00; A47L 13/50; A47L 13/51; A47L 13/52

[52] U.S. Cl. ..... 15/115; 15/105; 15/143 R; 15/145; 15/257.1; 15/257.2; 15/257.7

[58] Field of Search ..... 15/106, 114, 115, 116.1, 15/116.2, 120 R, 120 A, 257.1, 257.2, 257.7, 228, 171, 784, 176, 143 R, 143 A, 144 R, 144 A, 144 B, 145, 146, 147 R, 148, 149, 119 R, 159 R, 105

[56] References Cited

U.S. PATENT DOCUMENTS

| | | | |
|---|---|---|---|
| 1,327,597 | 1/1920 | Greene | 15/143 B |
| 2,639,454 | 5/1953 | Dory | 15/145 |
| 2,743,471 | 5/1956 | Forrester | 15/228 |
| 2,820,290 | 1/1958 | Porter, Jr. | 15/144 B |
| 2,832,089 | 4/1958 | Schwartz et al. | 15/145 |
| 3,324,494 | 6/1967 | Vosbikian | 15/257.2 |
| 3,382,523 | 5/1968 | Parsisson | 15/257.2 |
| 3,407,424 | 10/1968 | Lanzacone et al. | 15/145 |
| 4,325,157 | 4/1982 | Balint et al. | 15/144 B |
| 4,524,484 | 6/1985 | Graham | 15/144 B |

FOREIGN PATENT DOCUMENTS

| | | | |
|---|---|---|---|
| 2410806 | 9/1975 | Fed. Rep. of Germany | 15/257.2 |

*Primary Examiner*—Harvey C. Hornsby
*Assistant Examiner*—Joseph S. Machuga
*Attorney, Agent, or Firm*—J. Sanchelima

[57] ABSTRACT

A multi-purpose cleaning utensil capable of being compactly stored away. A tubular housing of sufficiently large inner diameter coaxially houses a handle member and a mop support member. The tubular housing member in turn is rigidly mounted to a dust collector member that also receives a broom head member. A threaded end at one end of the housing member is screwed through an opening through the top of the dust collector protruding a sufficient distance to come in contact with the broom head member thereby keeping it in place.

3 Claims, 2 Drawing Sheets

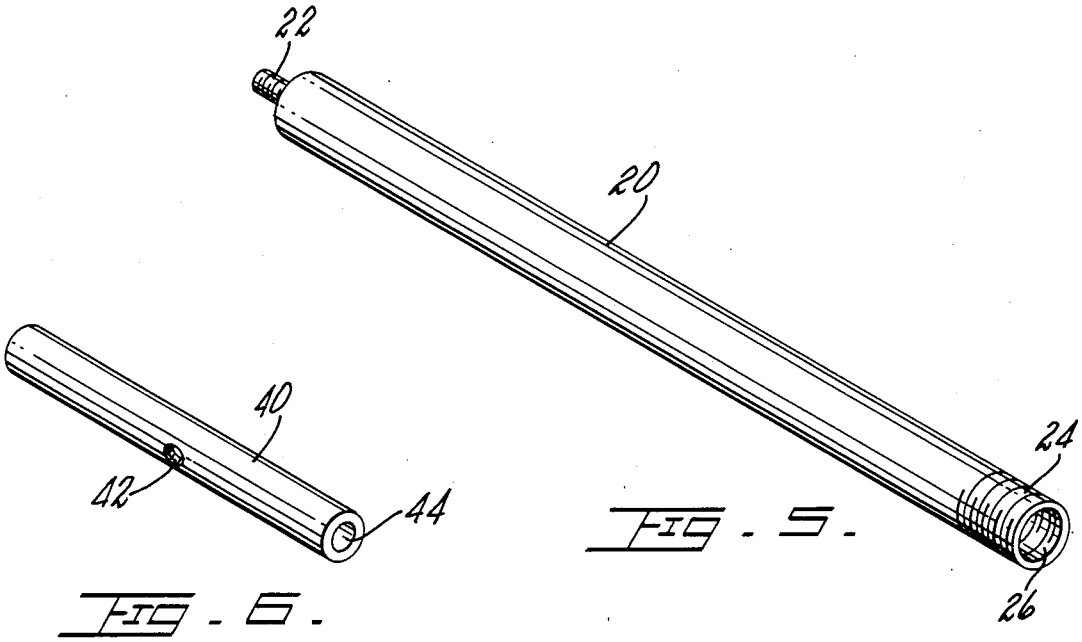
FIG. 5.
FIG. 6.
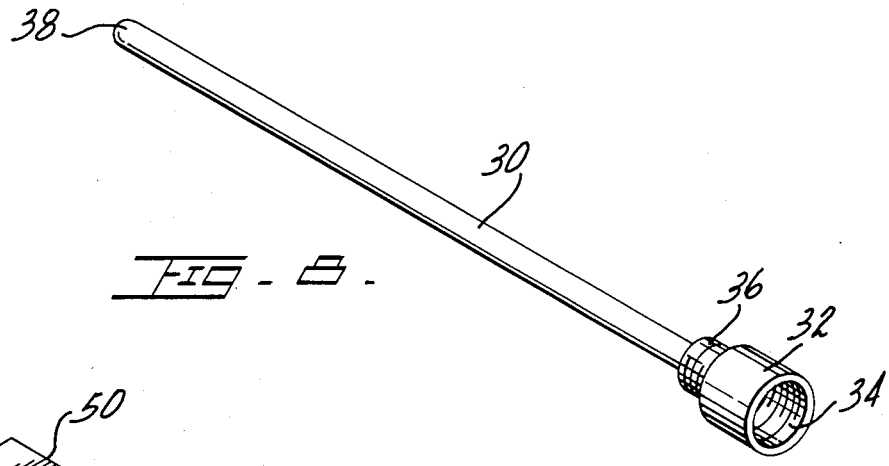
FIG. 8.
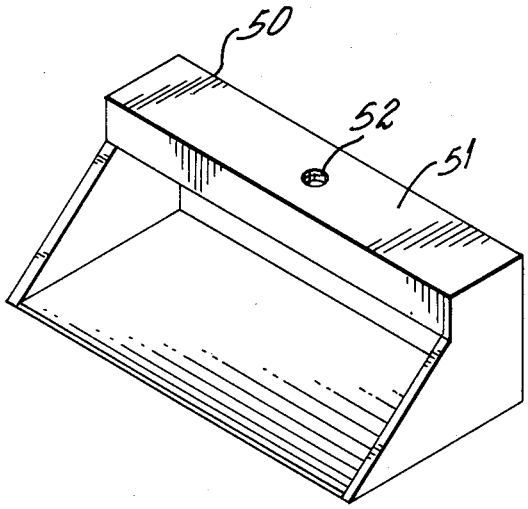
FIG. 7.
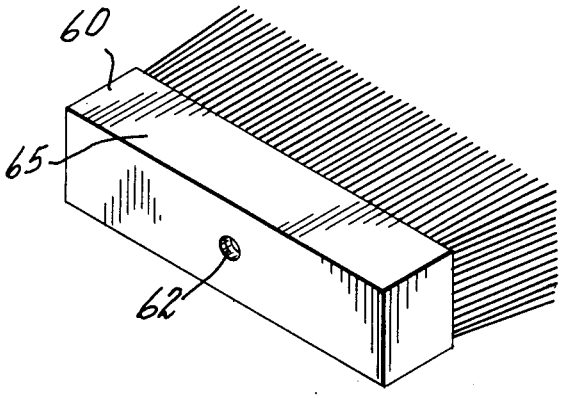
FIG. 9.

MULTIPLE USE CLEANING UTENSIL

BACKGROUND OF THE INVENTION

1. Field of the Invention.

The present invention relates to cleaning utensils, and more particularly, to such utensils that can be readily used for multiple purposes.

2. Description of the Related Art.

Cleaning utensils always occupy too much space in a typical household. Also, when a cleaning job is to be performed, the user must carry several utensils with similar handles thereby duplicating this essential component. Not infrequently all these bulky utensils are in the user's way. The need for a volumetrically efficient and desirable multiple use cleaning utensil is quite obvious.

SUMMARY OF THE INVENTION

It is one of the main objects of the present invention to provide a cleaning utensil that can be readily adapted to perform several tasks without having duplication of components.

It is another object of this present invention to provide a multiple use cleaning utensil that is volumetrically efficient when stored.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 5 is a perspective representation of the tubular housing member.

FIG. 6 shows the mop support member, in perspective.

FIG. 7 illustrates the dust collector member, in perspective.

FIG. 8 shows the elongated handle member, in perspective.

FIG. 9 represents the broom head member, in perspective.

DETAILED DESCRIPTION OF THE PREFERRED EMBODIMENT

Figure 1:
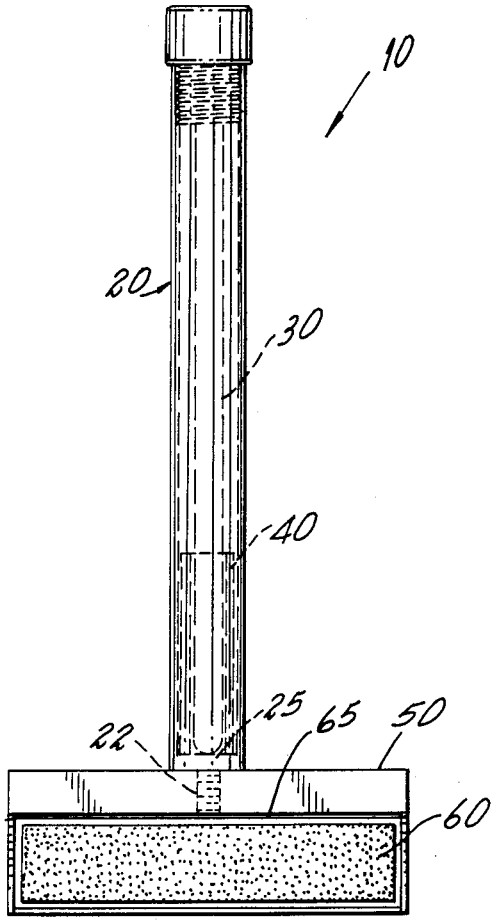
FIG. 1 represents a cross-sectional elevational side view of the cleaning utensil subject of the present application in its storage configuration.

Referring now to FIG. 1, where the present invention is generally referred to with numeral 10, it can be observed that it basically comprises tubular housing member 20, elongated handle member 30, mop support tubular member 40, a dust collector or dust pan member 50 and broom head member 60. All of these components are designed with suitable dimensions as shown in FIG. 1.

Figure 2:
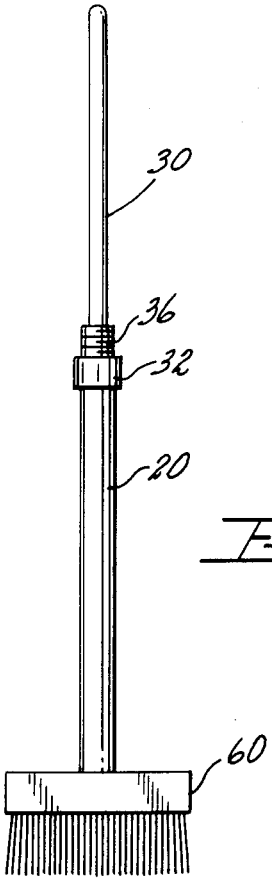
FIG. 2 shows the present invention in its broom configuration.
Figure 4:
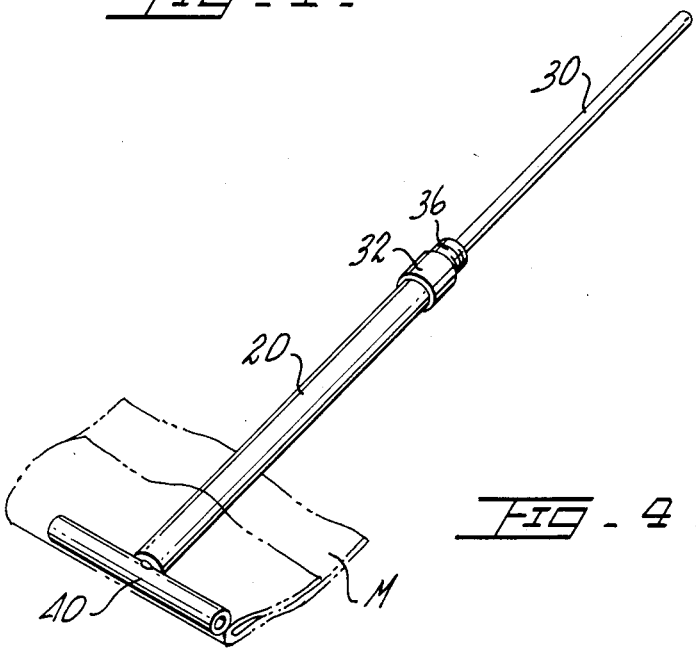
FIG. 4 is a representation of this invention in its dust collector configuration.
Figure 3:
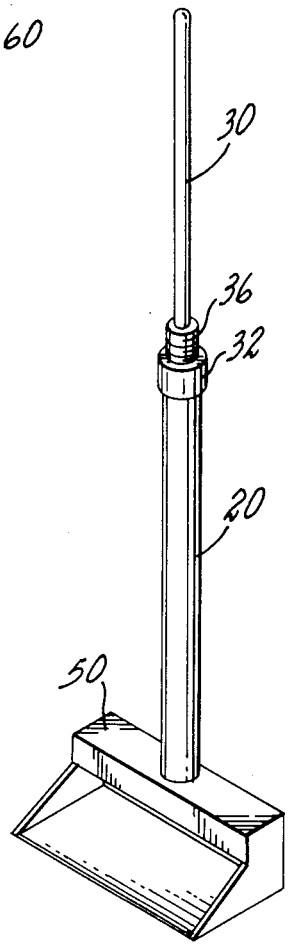
FIG. 3 illustrates the present invention in its mop configuration.

As shown in FIGS. 2 through 4, utensils 10 can be readily adapted to do the three most common cleaning tasks, namely, sweeping, mopping and collecting the dust or garbage. A mopping cloth M is used in the preferred embodiment with mop support member 40 which is basically an elongated member having an outer diameter smaller than the inner diameter of tubular housing member 20 and an inner diameter larger than the outer diameter of the handle portion of handle member 30.

In FIGS. 5 through 9, the components of utensil 10 are shown, individually. FIG. 5 shows tubular housing member 20 which includes an external threaded pin termination 22 on one end and external and internal threaded termination 24 and 26 on the other end. Pin 22 is rigidly mounted or integrally built on end wall member 25 that is rigidly mounted to one end of housing member 20. However, it is also possible to replace end wall 25 and pin 22 with simply an external thread at this end of member 20. This would cause mop support member, when stored, to drop down to come in contact with side 65, as it is explained below. For the broom configuration, tubular housing member 20 is removably mounted to broom head member 60 by screwing threaded pin 22 onto mating threaded opening 62. The other threaded end of housing member 20 is then removably mounted to tubular end 32 of handle member 30 which includes mating internal thread 34. Member 30 includes threaded sleeve 36 which is adjacent to tubular end 32 and is, preferably, integrally built on handle member 30. The rest of member 30 consists of an elongated shaft member of smaller diameter than threaded sleeve 36 which in turn has a smaller diameter than tubular end 32. For use in the mop configuration, end 24 is unscrewed from opening 62 and screwed on threaded opening 42 of mop support member 40. Member 40 is a hollow elongated piece having an outer diameter that is smaller than the inner diameter of member 20. The inner diameter of through opening 44 is sufficiently large to receive handle member 30. Similarly, end 24 would be removably mounted to threaded opening 52 on upper frame member 51 of dust collector member 50 to come u with the dust collector configuration.

In its storage configuration, housing member 20 is screwed to threaded through opening 52 and mop support member is slidably inserted therethrough to rest on end wall 25 of member 20. Threaded end 22 protrudes through opening 52 and comes in contact with side 65 of broom head member 60 thereby keeping it in place. End 38 of handle member 30 is then inserted through opening 44. Member 30 is screwed to housing member 20 with cooperating threaded portions 36 and 26.

Preferably, all components of utensil 10 are made out of a plastic material, such as PVC, that is resistant while inexpensive to manufacture in large quantities.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A cleaning utensil, comprising:

A. an elongated tubular housing member having two ends with external threads on each one;

B. An elongated handle member shorter than said tubular housing member, having a tubular termination on one end of said handle member with an internal thread that cooperates with one of said external threads so that said handle member removably mounts coaxially as an extension of said tubular housing member and the rest of said handle member having an outer diameter smaller than said housing member so that the rest of said handle member may be coaxially housed within said housing member when disassembled and stored away; and C. a broom head member having a threaded opening that cooperatively mates with the other external thread of said housing member;

D. a dust pan member having an upper frame member with a threaded opening that cooperatively mates with said other external thread of said housing member; and E. a mop support tubular member having an elongated shape having an outer diameter that is smaller than the inner diameter of said housing member and having an inner diameter that is larger than the outer diameter of said handle member so that said mop support member can be coaxially received within said housing member and said handle member can be coaxially received within said mop support member, and said mop support member further including a radially extending threaded opening substantially at its longitudinal middle for cooperatively receiving said other external thread of said housing.

2. The cleaning utensil set forth in claim 1 wherein said opening in said dust pan member is a through opening so that said other external threads of said housing member may protrude through said upper frame member.

3. The cleaning utensil set forth in claim 2 further including an end wall mounted at the end where said other external threads of said housing member is located and a pin perpendicular and rigidly mounted to said end wall and said other external threads of said housing member being located on said pin, and wherein said threaded openings of said broom and dust pan members cooperatively mate with said threaded pin.

* * * * *